US006898907B2

(12) United States Patent
Diamond

(10) Patent No.: US 6,898,907 B2
(45) Date of Patent: May 31, 2005

(54) STRUCTURES, WINDOW PROTECTION SYSTEMS AND METHODS FOR PROTECTING GLASS PANES DURING STORMS

(75) Inventor: Jeffrey H. Diamond, West Palm, FL (US)

(73) Assignee: Aranar, Inc., West Palm Beach, FL (US)

( * ) Notice: Subject to any disclaimer, the term of this patent is extended or adjusted under 35 U.S.C. 154(b) by 0 days.

(21) Appl. No.: 09/878,214

(22) Filed: Jun. 12, 2001

(65) Prior Publication Data

US 2002/0184841 A1 Dec. 12, 2002

(51) Int. Cl.[7] ..... E06B 3/26

(52) U.S. Cl. ..... 52/202; 52/2.11; 52/2.22; 52/406.1; 52/309.8; 52/746.1; 49/463; 411/521; 427/154

(58) Field of Search ..... 52/2.11, 2.14, 52/2.17, 2.19, 2.22, 2.24, 2.25, 202, 203, 406.1, 406.2, 309.8, 309.9, 406.3, 741.13, 746.1; 427/154, 421, 407.2; 49/463; 411/82, 930, 923, 520, 521, 523

(56) References Cited

U.S. PATENT DOCUMENTS

| | | | |
|---|---|---|---|
| 1,239,089 | A | 9/1917 | Day |
| 1,428,955 | A | 9/1922 | Grossman |
| 2,020,256 | A | 11/1935 | Copeman |
| 2,784,114 | A | 3/1957 | Miller |
| 3,091,551 | A | 5/1963 | Robertson |
| 3,411,562 | A | 11/1968 | Garrett |
| 3,455,865 | A | 7/1969 | Bolt et al. |
| 3,480,069 | A | 11/1969 | Handwerker |
| 3,486,918 | A | 12/1969 | Motter |
| 3,549,448 | A | 12/1970 | Dearing |
| 3,830,670 | A | 8/1974 | Van Thyne et al. |
| 3,830,760 | A | 8/1974 | Bengston |
| 4,010,311 | A | 3/1977 | Lewis et al. |
| 4,075,386 | A | 2/1978 | Willdorf |
| 4,145,855 | A | 3/1979 | Sheldon |
| 4,193,243 | A | 3/1980 | Tiner |
| 4,596,725 | A | 6/1986 | Kluth |
| 4,616,456 | A | 10/1986 | Parker |
| 4,636,425 | A | 1/1987 | Johnson et al. |
| 4,636,543 | A | 1/1987 | Helton |
| 4,809,478 | A | 3/1989 | Bernard |
| 4,971,130 | A | 11/1990 | Bentley |
| 5,004,632 | A | 4/1991 | McGarvey |
| 5,020,288 | A | 6/1991 | Swenson |
| 5,107,643 | A | 4/1992 | Swenson |
| 5,143,949 | A | 9/1992 | Grogan et al. |

(Continued)

FOREIGN PATENT DOCUMENTS

| | | |
|---|---|---|
| DE | 26 08 728 A1 | 9/1976 |
| DE | 141333 | 4/1980 |
| GB | 2 124 687 | 2/1984 |
| JP | 1115982 | 5/1989 |
| WO | WO 01/09475 A2 | 2/2001 |

*Primary Examiner*—Brian E. Glessner

(57) ABSTRACT

A compressible structure for temporarily protecting a glass pane of a window structure includes a shaping member for removable securement on the window structure and defining a cavity over the glass pane and a layer of solidified compressible material in said cavity providing protection for the glass pane. A window protection system includes a shaping member and a supply system for supplying a compressible material in fluidic form to a cavity of the shaping member, wherein the fluidic compressible material sets to form a layer of solidified compressible material. A protected window structure includes a window structure and a panel of solidified compressible foam material disposed over at least a portion of one or more glass panes of the window structure.

45 Claims, 9 Drawing Sheets

U.S. PATENT DOCUMENTS 5,186,978 A 2/1993 Woodhall et al.
5,194,299 A 3/1993 Fry
5,230,738 A 7/1993 Wheeler
5,281,436 A 1/1994 Swidler
5,302,413 A 4/1994 Woodhall et al.
5,362,786 A 11/1994 Woodhall et al.
5,411,760 A 5/1995 Woodhall et al.
5,468,538 A 11/1995 Nameche
5,484,820 A 1/1996 Mispreuve et al.
5,523,117 A 6/1996 Woodhall et al.
5,538,779 A 7/1996 Mispreuve et al.
5,603,190 A 2/1997 Sanford
5,866,260 A 2/1999 Adams, Jr. et al.
5,918,430 A 7/1999 Rowland
5,937,595 A 8/1999 Miller
5,937,596 A 8/1999 Leeuwenburgh et al.
5,943,832 A 8/1999 Russell
5,949,448 A 9/1999 Man et al.

STRUCTURES, WINDOW PROTECTION SYSTEMS AND METHODS FOR PROTECTING GLASS PANES DURING STORMS

CROSS-REFERENCE TO RELATED PATENT APPLICATION

This application is related to prior U.S. patent application Ser. No. 09/362,890 filed Jul. 29, 1999, the disclosure of which is incorporated herein by reference.

BACKGROUND OF THE INVENTION

1. Field of the Invention

The present invention relates to protection of glass panes during storm conditions and, more particularly, to structures positioned over glass panes to absorb forces from high winds and wind-borne debris to protect the glass panes from shattering and damage.

2. Discussion of the Prior Art

Protection of glass panes in buildings during storms has been a great problem in the past, and many efforts have been made to prevent the glass panes from shattering and falling into the building due to high winds, projectiles and debris thereby damaging the interior of the building due to the glass and due to wind and rain damage through the breached glass pane. Prior art attempts to protect glass panes in buildings from storm damage have included prefabricated storm shutters, plywood sheets, lamination systems and taping. Storm shutters are normally made of aluminum or other lightweight metal alloys, fiberglass, polyvinyl acrylate or other plastic. Storm shutters are fabricated to fit the exact measurements of window structures, including glass panes, to be protected and have the disadvantages of being expensive and requiring substantial time for fabrication such that storm shutters are not available unless ordered well in advance of a storm. Plywood sheets are generally sold in four-foot by eight-foot sheets with a thickness of ⅝ inch such that the plywood sheets weigh approximately 50 pounds each. The plywood sheets must be cut to fit the size of the window structures and are normally drilled and screwed into the building or window frame requiring craftsmanship, labor and hardware and, thus, having the disadvantages of being expensive and requiring substantial time to cover windows when a storm is approaching as well as being extremely heavy. Lamination systems, such as those supplied by 3M Corporation (e.g. Scotchshield) have the disadvantages of being films applied to the interior of the glass panes since they are designed to prevent shattered glass from collapsing to thereby prevent rain damage and glass fragments from becoming projectiles. The film is not particularly effective in preventing the glass from shattering and does not make the glass more shatter resistant. Since the film is usually on the interior of the glass, it cannot absorb enough energy from the glass fast enough to prevent a failure or fracture of the glass if the glass pane is struck by debris or projectiles. Accordingly, the primary use of lamination systems is to prevent shattered glass from falling apart. Taping of windows results, at best, in the holding of most of a fractured glass pane in place to reduce rain damage and the risk of individuals being cut.

U.S. Pat. No. 3,830,760 to Benngston and U.S. Pat. No. 4,596,725 to Kluth et al are exemplary of polyurethane foams and discuss one-component and two-component polyurethanes. U.S. Pat. No. 3,455,865 to Bolt et al, U.S. Pat. No. 3,486,918 to Motter, U.S. Pat. No. 4,636,543 to Helton, U.S. Pat. No. 5,020,288 to Swenson, U.S. Pat. No. 5,107,643 to Swenson, U.S. Pat. No. 5,143,949 to Grogan et al, U.S. Pat. No. 5,186,978 to Woodhall et al, U.S. Pat. No. 5,281,436 to Swidler, U.S. Pat. No. 5,302,413 to Woodhall et al, U.S. Pat. No. 5,362,786 to Woodhall et al, U.S. Pat. No. 5,411,760 to Woodhall et al and U.S. Pat. No. 5,523,117 to Woodhall et al, are representative of polymeric films or layers for glass and/or polymeric films or layers removable by peeling.

From the above, it will be appreciated that there is a great need for protection of glass panes in window structures installed in buildings due to storms where the protection can be quickly applied and is inexpensive while also being easily removed.

SUMMARY OF THE INVENTION

Accordingly, it is an object of the present invention to provide protection for glass panes overcoming the above-mentioned disadvantages of the prior art.

Another object of the present invention is to protect glass panes in buildings from storm damage by temporarily positioning a compressible structure over a glass pane and, after the storm passes, removing the compressible structure.

A further object of the present invention is to position a shaping member over a glass pane of a window structure in a building, wherein the shaping member is filled, prior to or subsequent to being positioned over the glass pane, with a fluidic compressible material which dries or cures to form a layer of solidified compressible material of sufficient thickness and properties to absorb energy from debris striking the shaping member during a storm.

Another object of the present invention is to utilize a shaping member to shape a fluidic polymeric foam material applied over a glass pane of a window structure such that the fluidic compressible material hardens to form a layer of solidified compressible material temporarily protecting the glass pane from damage due to storms.

An additional object of the present invention is to inflate a shaping member to a desired size in response to being filled, partially or entirely, with a fluidic compressible material which solidifies to form a compressible structure to protect a glass pane of a window structure in a building from storm damage.

It is also an object of the present invention to utilize a glass pane of a window structure in a building to form a wall of a cavity defined over the glass pane for being supplied with a fluidic compressible material which solidifies to protect the glass pane from damage.

The present invention has as a further object to position a plurality of compressible, structures over a glass pane of a window structure in a building, with the plurality of compressible structures covering the surface area of the glass pane to protect the glass pane from damage due to storms.

Yet another object of the present invention is to removably secure one or more pre-fabricated, polymeric foam panels over a glass pane of a window structure in a building to protect the glass pane from damage during storms.

It is a further object of the present invention to provide a cushioning effect between a glass pane and a solidified compressible material disposed over the glass pane to protect against damage from storms.

Still a further object of the present invention is to enhance the effectiveness of a compressible structure positioned over a glass pane of a window structure in a building to protect the glass pane from storm damage by utilizing a combination of solidified compressible materials of different densities in the compressible structure.

Some of the advantages of the present invention are that the compressible structures protect glass panes from shattering during storms, the compressible material, where disposed within a shaping member, is protected from exposure to the elements, the compressible structures are easy to apply and remove, the compressible structures typically weigh much less than plywood or similar materials conventionally utilized to cover window structures, a two-component supply system for the fluidic compressible material provides long shelf life for easy and instant use at a moment's notice, the compressible structures can be installed by one person and will not lose their shape or protective qualities during long periods of exposure to the elements, the shaping members can be filled with the fluidic compressible material at one or a few locations so that the supply system for the fluidic compressible material need not be moved to the site of each window structure, the shaping member can be formed of flexible or collapsible materials to occupy minimal space for storage when not filled with the compressible material, the compressible structures can be releasably secured on window structures in various ways including adhesively and/or mechanically, the compressible material itself can be used to releasably adhere the compressible structures to the glass panes, securing mechanisms including Velcro or similar materials can be used to releasably secure the compressible structures on the window structures, and the fluidic compressible material can be sprayed or poured into the shaping member for ease of use.

These and other objects, advantages and benefits are realized with the present invention as generally characterized in a compressible structure for temporarily protecting a window structure and comprising a shaping member for removable securement on the window structure and defining a cavity over one or more glass panes of the window structure, and a solidified compressible material in the cavity providing a protective layer over the one or more glass panes.

The present invention is also generally characterized in a window protection system comprising a shaping member for removable securement on a window structure and defining a cavity over one or more glass panes of the window structure, a port in the shaping member providing an opening into the cavity and a supply system for supplying a fluidic compressible material to the cavity which solidifies or hardens to form a layer of solidified compressible material over the one or more glass panes. The shaping member and solidified compressible material form a compressible structure protecting the one or more glass panes.

The present invention is further generally characterized in a temporarily protected window structure comprising a window structure and a compressible structure removably secured on the window structure. The compressible structure includes a layer of solidified compressible foam material disposed over one or more glass panes of the window structure to protect the one or more glass panes from damage. The layer of solidified compressible material may include a single layer or multiple layers of solidified compressible materials of different densities.

Other objects and advantages of the present invention will become apparent from the following description of the preferred embodiments taken in conjunction with the accompanying drawings wherein like parts in each of the several figures are identified by the same reference characters.

DESCRIPTION OF THE PREFERRED EMBODIMENTS

The present invention relates to the positioning of a compressible structure over a glass window structure in a building in order to protect the window structure and the interior of the building from damage caused by high winds and wind-borne debris during storms. Buildings to which the invention applies may be both commercial and residential. The glass window structure can be of any conventional construction where one or more glass panes are held in place in a frame of one or multiple parts surrounding the one or more glass panes, such as sash windows, casement windows, slidably or pivotally movable windows and doors, non-movable windows, protruding windows and recessed windows.

Figure 2:
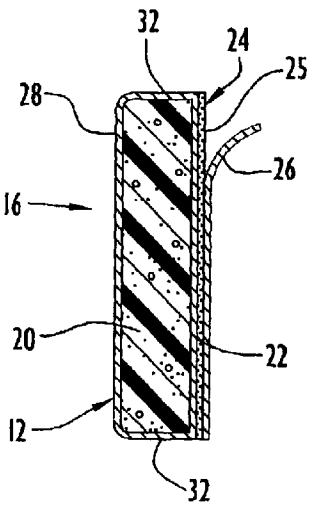
FIG. 2 is a side sectional view of a compressible structure formed when the shaping member of FIG. 1 is filled with solidified compressible material.
Figure 1:
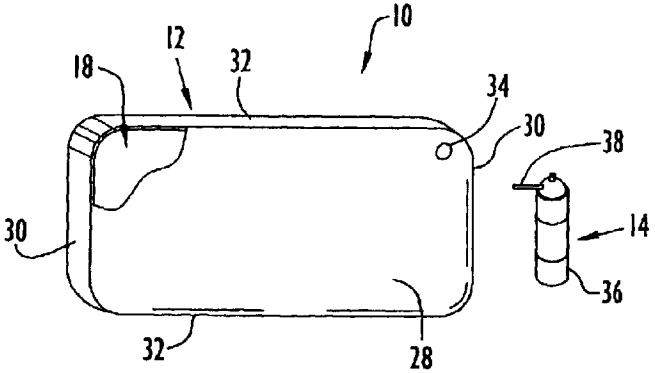
FIG. 1 is a front perspective view of a window protection system according to the present invention including a shaping member and a supply system for filling the shaping member with a fluidic compressible material which hardens to form a solidified compressible material.

FIG. 1 illustrates a window protection system 10 according to the present invention including a shaping member or mold 12 and a supply system 14 for supplying a fluidic compressible material to shaping member 12 which hardens, cures, sets or solidifies to form a layer of solidified compressible material 20 thereby forming a compressible structure 16 as illustrated in FIG. 2. Shaping member 12 preferably has a perimetrical size to fit closely within a recess defined by the frame of a window structure or to overlap the frame some amount so as to cover one or more glass panes mounted within the frame. The shaping member 12 can be fabricated from various materials, such as paper, cardboard, cellulosic material, wood, polymer, metal and composite materials, with a flexible polymeric material being a preferred material. Use of a flexible material allows the shaping member 12 to be flattened, collapsed and/or folded to occupy minimum space for storage prior to being filled with the compressible material and to allow for size adjustment when the shaping member is filled with the compressible material as explained further below. The shaping member 12 could also be fabricated from expandable or stretchable materials.

The shaping member 12 is in the nature of a hollow membrane or body having a plurality of walls defining an interior cavity 18 for receiving or holding compressible material 20 as shown in FIG. 2. A back or rear wall 22 of shaping member 12 carries a securing element 24 by which the shaping member is removably secured over the one or more glass panes. The securing element 24 for compressible structure 16 includes a layer of adhesive 25 covering the outer surface of the back wall 22 partially or entirely and a protective cover sheet 26 disposed over the adhesive layer 25 prior to use. The cover sheet 26 is removable as shown in FIG. 2 to uncover or expose the adhesive layer 25 for attachment to the window structure as explained further below. A front wall 28 of the shaping member 12 faces exteriorly when the shaping member 12 is secured over the exterior of the one or more glass panes and thusly faces the storm for which the compressible structure 16 is to provide protection to the one or more glass panes. Opposing side walls 30 and top and bottom walls 32 extend between back wall 22 and front wall 28 and define a preselected depth for cavity 18 between back wall 22 and front wall 28 corresponding to a desired depth for the compressible material. Typically, the depth of cavity 18 will vary from 0.5 inch to 12 inches depending upon the size of the shaping member and the dimensions of the window structure to be protected. The walls of shaping member 12 are of sufficient thickness, rigidity and/or strength to shape and support the fluidic compressible material so that the layer of solidified compressible material 20 is positioned in front of the one or more glass panes and, preferably, in a plane parallel or substantially parallel to the plane of the one or more glass panes.

A port 34 in shaping member 12 provides an opening into cavity 18 to allow the cavity to be filled with the fluidic compressible material. The port 34 for shaping member 12 is located in the front wall 28 near the upper right corner; however, the port 34 can be provided in any of the front, back, side, top or bottom walls at any suitable location to establish communication with the cavity 18 from externally of the shaping member. Where the shaping member 12 is to be filled with the fluidic compressible material prior to securement thereof over the one or more glass panes, the port 34 can be provided in any of the back, front, side, top or bottom walls. Where the shaping member 12 is to be filled with the fluidic compressible material after the shaping member 12 is secured over the one or more glass panes, the port 34 typically would be provided in the front, side, top or bottom walls for ease of access and use. Shaping member 12 would typically be supplied in a flattened or collapsed condition prior to the compressible material being supplied to cavity 18, and the unfilled shaping member can be folded to facilitate storage. Shaping member 12 is filled with the fluidic compressible material to obtain the compressible structure 16, and the fluidic compressible material is supplied to cavity 18 via the port 34.

A desirable compressible material is a polymeric material or foam and, preferably, a polyurethane foam, because of the relatively light weight and effective cushioning and energy absorption properties of the solidified compressible material obtained therewith. Other polymeric foams can be utilized including high and low density foams of polyethylene, polypropylene and polyurethane and modified styrene foams, particularly high impact polystyrene foams modified with polybutadiene. Some examples of open cell, i.e. low density foams, include polyether and polyester polyurethanes. Examples of closed cell foams include polyurethane, ethylene propylene diene monomer (EPDM), neoprene, styrene-butadiene copolymer rubber (SBR), nitrile-butadiene copolymer rubber (NBR), ethylene vinyl acetate (EVA), polyvinyl chloride (PVC) and (PVR/NBR). Additionally, cross-linked polyethylene, silicone and polystyrene foams and polyethylene can be used.

The supply system 14, shown in FIG. 1, includes a supply tank 36 containing a quantity of the compressible material in fluidic form and having a delivery device 38 such as a discharge nozzle. The delivery device or nozzle 38 may be inserted into port 34 to allow for easy filling of cavity 18 with the fluidic compressible material. The fluidic compressible material may be sprayed into cavity 18 from the delivery device or, if the fluidic compressible material is too viscous to be sprayed or if the spray pressure is insufficient, the fluidic compressible material may be poured under pressure into cavity 18 from tank 36. The fluidic compressible material is supplied to cavity 18 until the cavity is filled to a desired amount and, typically, the cavity will be completely filled. Once the cavity is filled, the delivery device or nozzle is removed from the port 34, which will be closed by the compressible material or foam and is thusly self-sealing, since the fluidic compressible material or foam sets, cures, hardens or solidifies quickly to form the solidified compressible material 20. The solidified compressible material preferably has twice as great compression strength in a direction parallel to the foam rise, i.e. perpendicular to back and front walls 22 and 28, as compared with the compression strength in a direction perpendicular to the foam rise. The location of port 34 in front wall 28 ensures that the rise of the foam will generally be in a direction perpendicular to the back and front walls and, therefore, perpendicular to the one or more glass panes. The compression strength and other physical strength characteristics will vary with the type of foaming system utilized. Compression strength values from 15 to 40 psi can be obtained with 2 lbs/ft$^3$ density 1 urethane foams. A compression strength of 30 psi can be obtained with foam densities from 1.0 to 10.0 lbs/ft$^3$. Many foams will be in the range of 5.0 lb/ft$^3$. With the variation in compression strength values related to density, a generalized correlation of strength with density can be obtained.

A solidified compressible material formed from polyurethane or polyethylene foam provides increased energy absorption from projectiles as compared with a non-foam polymeric material due to the mechanical properties of the foam's cell or pore structure. The cells or pores preferably have diameters in the range of from 0.005 mm to 5.0 mm and, most preferably, in a range of from 0.01 mm to 0.03 mm and create a spongy three-dimensional, compressible, elastomeric web pattern with entrapped gas to absorb energy. The solidified compressible material formed from polyurethane or polyethylene foam preferably has a thickness within the shaping member, in a direction perpendicular to the one or more glass panes, in a range of from 0.5 inch to 12.0 inches corresponding to the depth of cavity 18 and, most preferably, in a range of from 1.0 to 4.0 inches to form an elastomeric, spongy cushion preventing shattering or fracturing of the underlying one or more glass panes. The depth of cavity 18 can be preselected to provide the desired thickness of polyurethane or polyethylene foam upon completion of the filling step, the fluidic polyurethane or polyethylene foam being shaped and supported by the shaping member to form a layer of solidified compressible material over the one or more glass panes.

Figure 3:
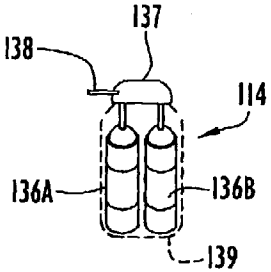
FIG. 3 is a front perspective view of an alternative supply system for the window protection system.

A one-component or two-component supply system may be utilized to fill cavity 18 with the fluidic compressible material. A one-component system is shown in FIG. 1, wherein tank 36 contains a fluidic compressible material including a polymeric blend such as a polymeric/polyol, polyurethane prepolymer and a polymeric hydrocarbon propellant to be delivered as a foam from delivery device 38. A two-component supply system 114 is shown in FIG. 3, wherein a first supply tank 136A contains component A, such as a polymeric polyol, a second supply tank 136B contains component B, such as disocyanate, and a mixing head 137 statically blends and reacts components A and B for delivery as a fluidic compressible material or foam through the delivery device or nozzle 138. Components A and B can be housed in a single container 139 as shown in dotted lines. A catalyst may be added to either supply system to decrease or reduce the cure time. The supply system 114 can be provided without mixing head 137, with component A being a first fluidic compressible material and component B being a second fluidic compressible material for selective discharge from the delivery device 138 to form a multi-layer compressible structure comprising multiple layers of first and second solidified compressible materials of different densities as described below.

Figure 4:
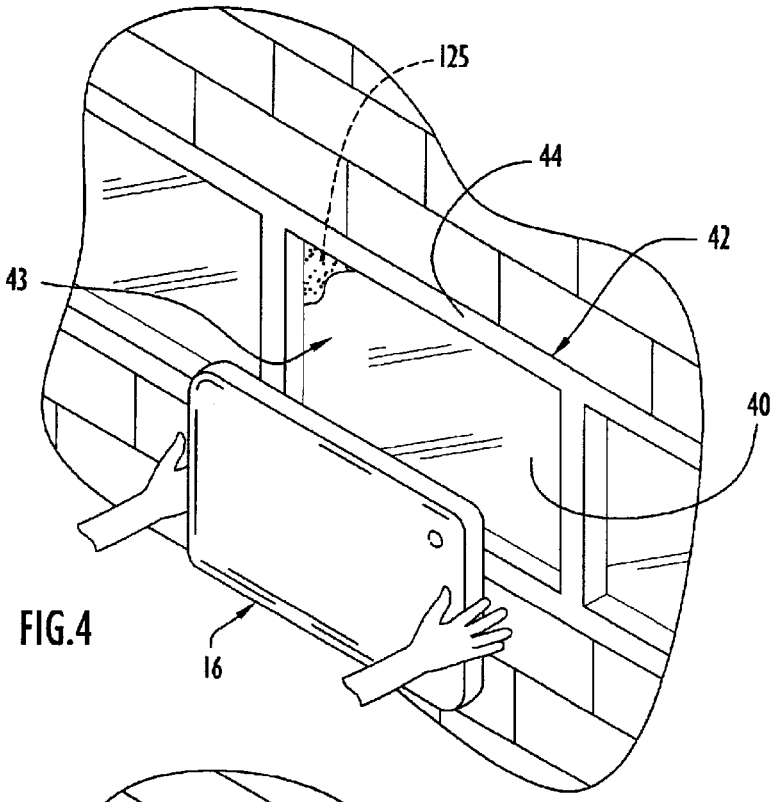
FIG. 4 is a front perspective view of the compressible structure of FIG. 2 being positioned over the exterior of a glass pane of a window structure in a building.

Compressible structure 16, i.e. shaping member 12 and solidified compressible material 20, is releasably or removably secured over the one or more glass panes of the window structure, or the shaping member 12 is releasably or removably secured over the one or more glass panes of the window structure prior to being supplied with the fluidic compressible material which forms solidified compressible material 20. FIG. 4 illustrates compressible structure 16 being positioned over the exterior facing side or surface of a glass pane 40 of a window structure 42 in a building. The glass pane 40 is surrounded and supported by a frame 44 of window structure 42, and the glass pane 40 is disposed in a recess 43 circumscribed by the frame 44. The frame 44 thusly circumscribes an area containing exposed glass. The compressible structure 16, wherein shaping member 12 has already been filled with the fluidic compressible material to form the layer of solidified compressible material 20 as described above and wherein the cover sheet 26 has been removed to expose the adhesive layer 25, is positioned over the glass pane 40 to fit closely or snugly within the recess 43. The compressible structure 16 is pressed firmly against the glass pane 40 so that the adhesive layer 25 contacts the exterior facing side or surface of the glass pane and releasably secures the compressible structure thereto to form a protected window structure. In the protected window structure, the body of solidified compressible material 20 is of a size to cover the area circumscribed by frame 44 at least substantially in its entirety, and FIG. 4 illustrates the body of compressible material covering the entirety of the area circumscribed by frame 44. Filling the shaping member 12 with the fluidic compressible material prior to its securement over the glass pane allows the supply system to be kept in a central location rather than requiring its transport to numerous different locations where windows are to be protected. Also, the shaping member could be filled at a remote location, for example at a warehouse, allowing a large number of compressible structures to be formed at one location. The compressible structure can be secured over the window structure a few minutes after filling the shaping member with the fluidic compressible material. An extendable arm or pole can be used to facilitate installation.

Figure 5:
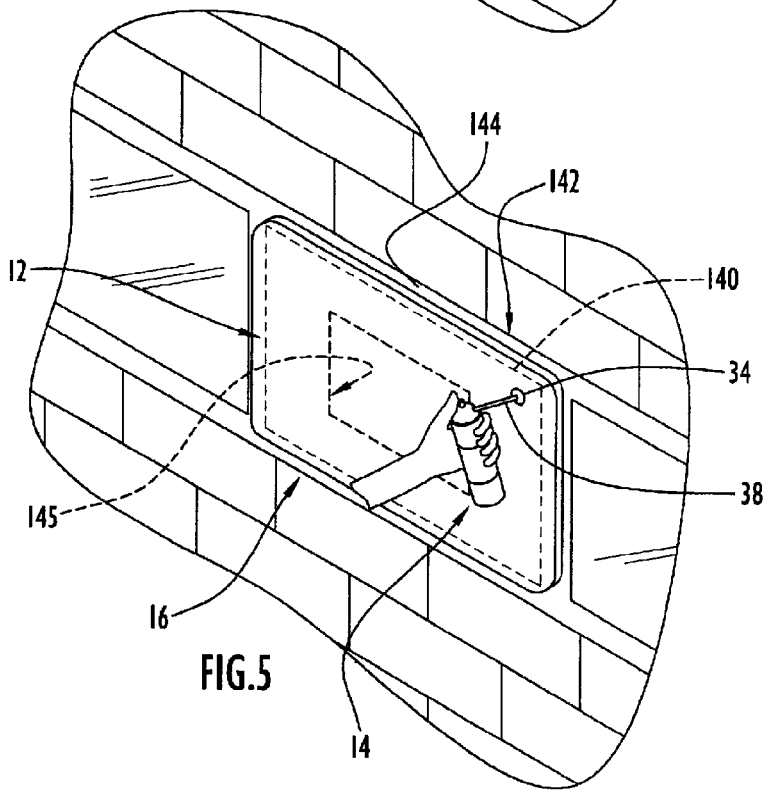
FIG. 5 is a front perspective view of the shaping member of FIG. 1 positioned over the exterior of a glass pane of a window structure in a building and being filled with a fluidic compressible material to form the compressible structure in situ.

Alternatively, the cover sheet 26 is removed to expose the adhesive layer 25, and the shaping member 12 is pressed firmly against the exterior facing side or surface of a glass pane 140 prior to the shaping member being filled with the fluidic compressible material as shown in FIG. 5. The fluidic compressible material is then supplied to the cavity 18 via the delivery device or nozzle 38 of the supply system 14 inserted into port 34 as described above. The fluidic compressible material cures to form the layer of solidified compressible material 20, thereby forming the compressible structure 16 in situ to form a protected window structure. FIG. 5 illustrates the shaping member 12 applied over a glass pane 140 which is not recessed within the frame 144. Also, the glass pane 140 has a perimeter slightly smaller than the perimeter of the shaping member 12 such that the shaping member overlaps the frame 144 a small amount. The body of solidified compressible material thusly covers the entirety of the area circumscribed by frame 144 and containing the exposed glass 140. Accordingly, the adhesive layer 25 is pressed against the frame 144 where the shaping member overlaps the frame. In this manner, the shaping member 12 is releasably secured to the frame 144 as well as to the exterior surface of the glass pane 140.

The compressible structure 16 is deployed over the window structure to be protected in advance of the arrival of a storm. When the storm arrives, the layer of solidified compressible material absorbs energy and provides a shock absorption effect protecting the one or more glass panes from damage. The compressible structure prevents shattering of the one or more glass panes, provides an insulative effect, and protects the interior of the building. After the storm passes, the compressible structure 16 can be easily removed from the window structure by detaching the adhesive layer 25 from the window structure. A compressible structure can be removed from the exterior side of the building; or, if the window structure is movable (e.g. pivotal or on tracks), the compressible structure can be removed from the interior side of the building without the use of a ladder by opening the window and pulling the compressible structure off the window structure and into the building. If the windows are not movable or do not open, an extension arm or pole can be used to remove the compressible structure. The compressible structure will normally be disposed of subsequent to use; however, the compressible structure could be retained for future re-use.

It should be appreciated that the securing element should be capable of holding the compressible structure over the one or more glass panes during a storm yet should be easily detachable from the window structure after the storm has passed. Where a pressure sensitive adhesive is utilized as the securing element as illustrated for compressible structure 16, the adhesive should provide sufficient holding strength for the compressible structure yet should be detachable from the window structure without excessive force. It is also desirable that the adhesive leave little or no residue on the window structure, particularly residue that is difficult to remove. It should also be appreciated that the securing element need not be attached to or carried by the compressible structure prior to use in that the securing element can be provided separate from the compressible structure. Various securing elements can be utilized with the compressible structure including adhesives and/or mechanical securing devices such as clips. Where the securing element is an adhesive, the adhesive could be separately applied to the window structure and the compressible structure or shaping member can thereafter be secured thereto.

As an example of the above, the compressible structure 16 can be provided without a securing element, and a securing element, such as adhesive layer 125, can be provided on the window structure as shown by dotted lines in FIG. 4. The adhesive layer 125 can be applied to all or part of the exterior surface of glass pane 40, for example, to contact the compressible structure 16 or shaping member 12 when it is pressed against the glass pane. Additionally or alternatively, the adhesive layer 125 can be applied to one or more surfaces of frame 44 defining the recess 43 so as to be contacted by one or more of the side, top and or bottom walls of the compressible structure when it is positioned within the recess 43. In the procedure illustrated by FIG. 5, the adhesive layer 125 could be applied, for example, to the portion of frame 144 overlapped by the compressible structure 16. The compressible material itself can serve as the securing element in that the fluidic compressible material or polymeric foam can be used to contact the window structure and adhere the compressible structure thereto as it solidifies or cures. As an example, FIG. 5 illustrates in dotted lines a cut-out or opening 145 in the back wall of shaping member 12, in which case shaping member 12 may be provided without a securing element. The shaping member is manually held in place against the glass plane 140 as it is filled with the fluidic compressible material. As the fluidic compressible material fills the cavity of the shaping member and rigidifies or cures, it contacts the glass pane and will become adhered thereto with sufficient force to hold the shaping member in place. Of course, the shaping member, and the resulting compressible structure, can be provided with various different cut-outs or openings at various different locations on the shaping member to establish contact of the compressible material with the window structure, including the glass pane and/or frame, in order to adhere the shaping member thereto. Cut-outs or openings in the shaping member by which the compressible material adhesively contacts 11 the window structure can be used in addition to a securing element for extra holding force. Since the foam can be very adherent by nature, the adhesive properties of the foam can be adjusted and/or a release sheet or film can be applied to the window structure to facilitate removal of the compressible structure as disclosed in prior patent application Ser. No. 09/362,890 filed Jul. 29, 1999, now U.S. Pat. No. 6,289,642 and incorporated herein by reference.

Figure 6:
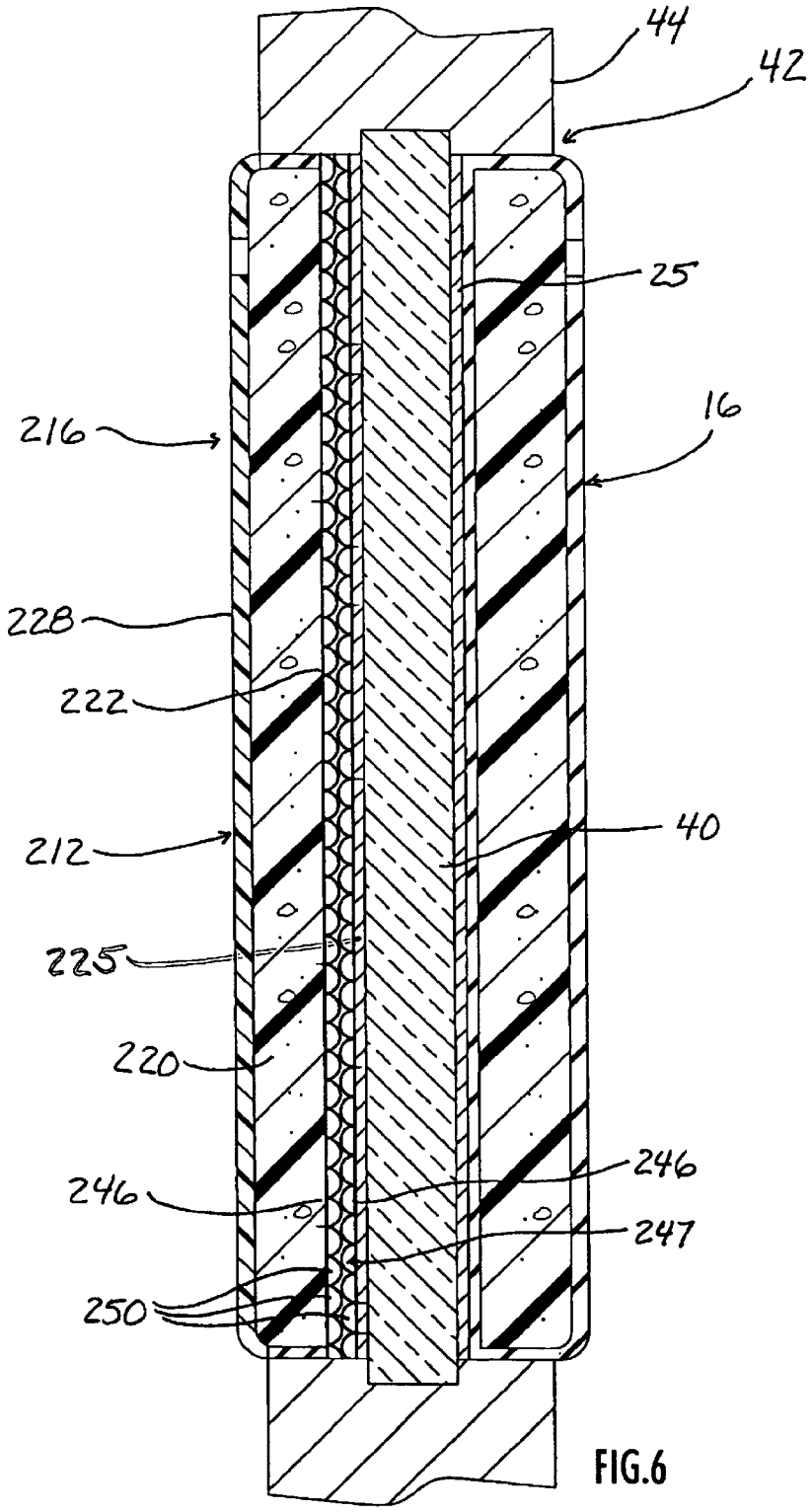
FIG. 6 is a side sectional view showing the compressible structure of FIG. 2 positioned over the interior of a glass pane of a window structure in a building and a modified compressible structure positioned over the exterior of the glass pane.

Compressible structures could be placed over both the exterior surface and the interior surface of a glass pane for increased protection. FIG. 6 shows a protected window structure formed by compressible structure 16 secured over an interior surface of a glass pane 40 of window structure 42 and a modified compressible structure 216 secured over the exterior surface of glass pane 40. Compressible structure 16 fits closely within the recess of frame 44 and is secured to the interior surface of glass pane 40 via adhesive layer 25 contacting the interior surface of glass pane 40 in the manner described above. Compressible structure 216 is similar to compressible structure 16 except that the front wall 228 of shaping member 212 is made of a relatively higher strength material, and the back wall 222 thereof is designed to provide a cushioning effect between glass pane 40 and the solidified compressible material 220. The front wall 228 is made of a material having a higher tensile strength and higher impact and tear resistance than the materials used for the remaining walls of shaping member 212. The back wall 222 is constructed from multiple spaced layers 246, each preferably a layer of polymeric film such as polyethylene, polyurethane or polystyrene, and a cushioning structure 247 therebetween. The cushioning structure 247 is formed by a plurality of air cell units 250 between the layers 246, and the adhesive layer 225 is carried by the layer 246 located on the outer or back side of the compressible structure. The back wall 222 is similar to the material known as "bubble wrap", with the air cell units 250 varying in size from 0.001 inch to 12 inches. The air cell units 250 contain pockets of air and act as a protective cushion. In particular, the back wall 222 aids in separating the solidified compressible material, which absorbs the greatest force from impacts, from the glass pane 40 and acts as a protective cushion between the glass pane and the solidified compressible material. The back wall 222 also provides an insulative effect. The compressible structure 216 can be formed in situ on the window structure or can be formed prior to being positioned on the window structure as described above.

Figure 7:
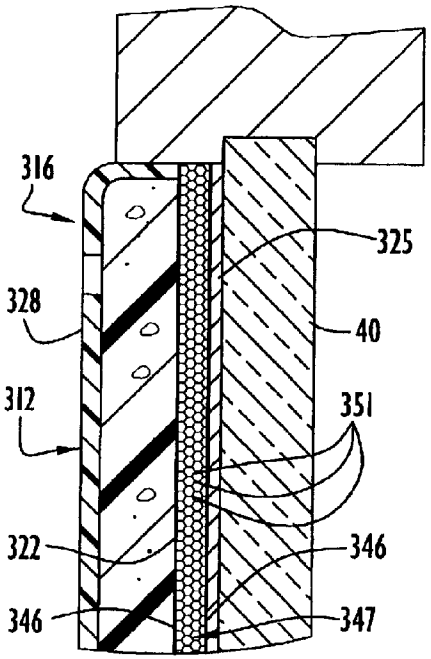
FIG. 7 is a fragmentary side sectional view of another modified compressible structure positioned over the exterior of a glass pane of a window structure.

Another modified compressible structure is illustrated at 316 in FIG. 7, which illustrates compressible structure 316 secured over the exterior of glass pane 40 without a compressible structure being secured over the interior of glass pane 40. Compressible structure 316 is similar to compressible structure 216 except for the construction of back wall 322 and front wall 328. Back wall 322 is similar to back wall 222 and includes spaced layers 346, with the adhesive layer 325 being carried by the layer 346 that is located on the back or outer side of the compressible structure. However, back wall 322 differs from back wall 222 in that polymeric particles 351, such as styrene particles, are disposed between layers 346 and form the cushioning structure 347. The front wall 328 differs from the front wall 228 in that the front wall 328 is made of the same material as the side, top and bottom walls of shaping member 312.

Figure 8:
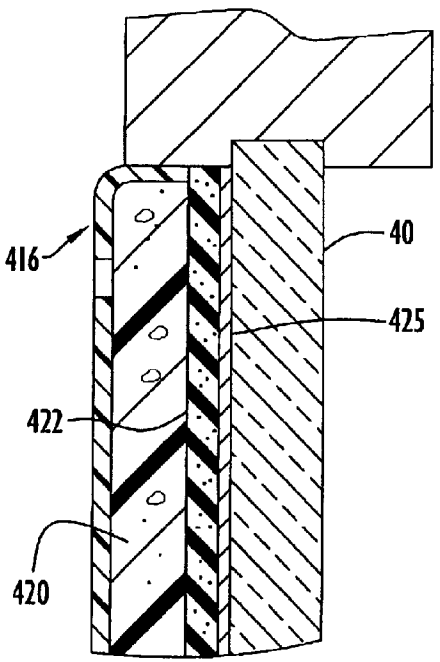
FIG. 8 is a fragmentary side sectional view of a further modified compressible structure positioned over the exterior of a glass pane of a window structure.

FIG. 8 illustrates at 416 a further alternative compressible structure secured over the exterior of glass pane 40 and having a back wall 422 which provides a cushioning effect. Compressible structure 416 is similar to compressible structure 316 except that the back wall 422, which carrier adhesive layer 425, is made of a layer of polymeric sponge material providing the cushioning effect between glass pane 40 and solidified compressible material 420.

Figure 9:
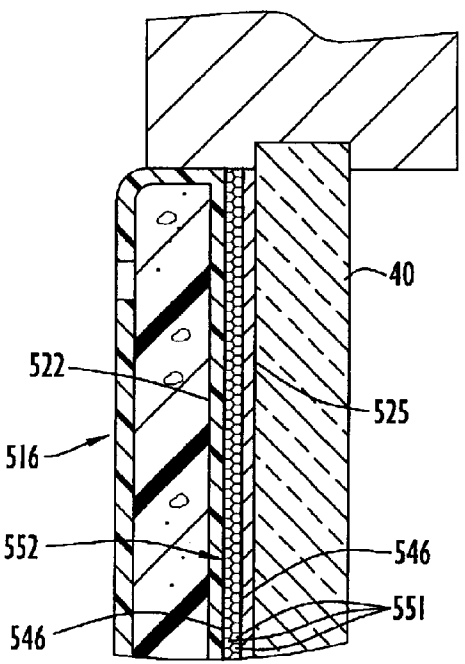
FIG. 9 is a fragmentary side sectional view of an additional modified compressible structure positioned over the exterior of a glass pane of a window structure.

Another alternative compressible structure 516 is illustrated in FIG. 9 secured over the exterior of glass pane 40. Compressible structure 516 is similar to compressible structure 16 except that compressible structure 516 includes a cushioning element 552 interposed between back wall 522 and adhesive layer 525. Cushioning element 552 is contiguous with back wall 522 and includes spaced layers 546 with a cushioning structure comprising polymeric particles 551 therebetween as described for back wall 322. The cushioning element 552 can alternatively be-constructed as a layer of polymeric sponge as described and illustrated for back wall 422 or as a plurality of layers of polymeric material having air cell units therebetween as described and illustrated for back wall 222.

Figure 10:
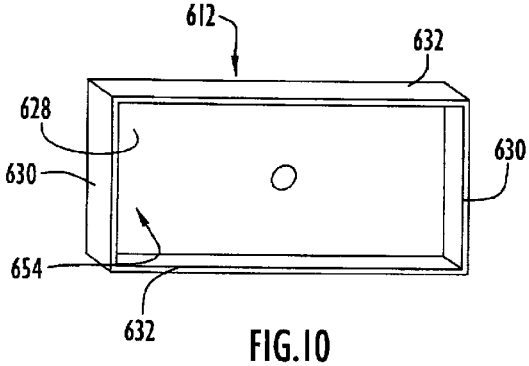
FIG. 10 is a rear perspective view of an alternative shaping member.

An alternative shaping member 612 is illustrated in FIG. 10 and differs from shaping member 12 primarily in that the shaping member 612 is provided without a back wall. Shaping member 612 is prefabricated or pre-built with interconnected side walls 630 and top and bottom walls 632 defining or circumscribing an opening 654 closed along one side by front wall 628. The side, top and bottom walls are positioned to be oriented 900 to a window structure to which the shaping member 612 is to be temporarily secured. The side, top and bottom walls can be made of various materials including polymeric, paper, cardboard, various cellulosic materials, wood, metal, or composite materials. Preferably, the front wall 628 is a polymeric film and, desirably, a high tensile strength polymeric film. The shaping member 612 can be constructed with various shapes and sizes in accordance with the shape and size of a window structure to be protected. The width of the side, top and bottom walls can be selected to correspond to a desired depth for the solidified compressible material within shaping member 612.

Figure 11:
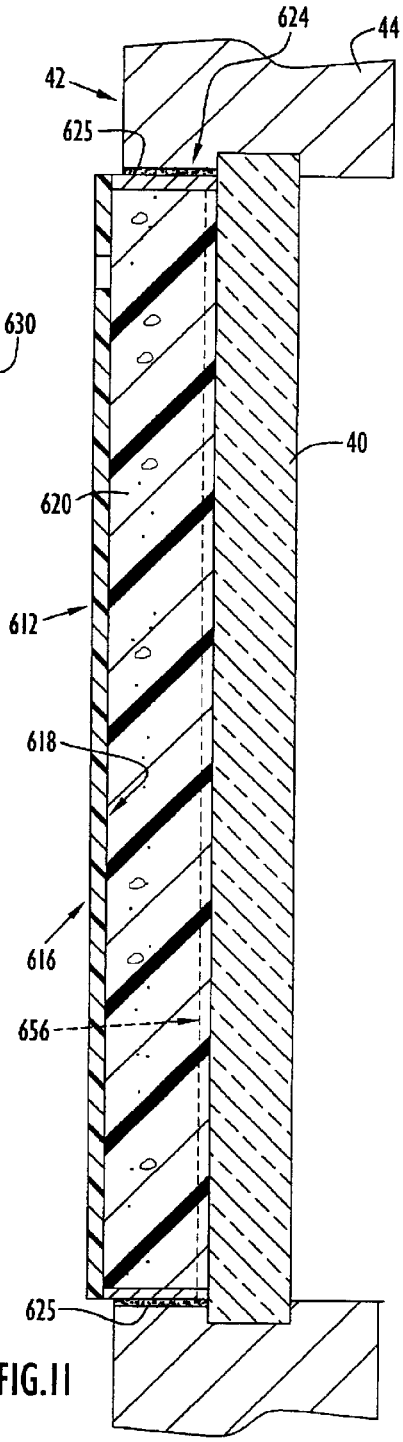
FIG. 11 is a side sectional view of yet another modified compressible structure obtained with the shaping member of FIG. 10 over the exterior of a glass pane of a window structure in a building.

The shaping member 612 is used by positioning it over a window structure as shown in FIG. 11, which illustrates the shaping member 612 positioned within a recess of window structure 42 so as to be disposed over the exterior of glass pane 40. The shaping member 612 has a perimetrical size corresponding to the size of the recess of window structure 42 and thus fits snugly or closely within the recess. The shaping member 612 is removably attached to the window structure via a securing element 624 including an adhesive layer 625 applied along the surfaces of frame 44 circumscribing the recess. Accordingly, the adhesive layer 625 contacts and adheres to the side, top and bottom walls of the shaping member 612 within the recess. The shaping member 612 is positioned in the recess so that the exterior surface of the glass pane 40 contacts the rearward edges of the side, top and bottom walls and thereby closes the opening 654 and forms a cavity 618. FIG. 11, therefore, is illustrative of a procedure wherein the glass pane forms the back wall of and completes the cavity for receiving the fluidic compressible material. Once the shaping member 612 is properly positioned over the glass pane 40, the cavity 618 is supplied with the fluidic compressible material to form the layer of solidified compressible material 620 as described above thereby forming the compressible structure 616. If desired, a release sheet or film 656, shown in dotted lines, can be applied over the exterior surface of glass pane 40 prior to positioning the shaping member 612 thereon, such a release sheet or film being described in the prior application incorporated herein by reference. The compressible structure 616 will typically be deployed in advance of a storm and, after the storm passes, the compressible structure 616 is removed from the window structure 42.

Figure 12:
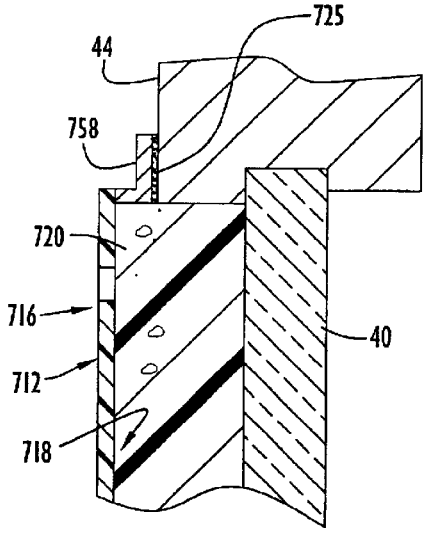
FIG. 12 is a fragmentary side sectional view of yet a further modified compressible structure disposed over the exterior of a glass pane of a window structure.

A further alternative shaping member is illustrated in FIG. 12 at 712. The shaping member 712 is similar to the shaping member 612 except that the side, top and bottom walls of shaping member 712 have an L-shaped configuration defining a peripheral rim or lip 758 which can be placed against the window frame 44. The lip 758 can be secured to the window frame 44 by a securing element, such as an adhesive layer 725 between the lip 758 and a front surface of the frame 44. Of course, the shaping member 712 can be provided with the adhesive layer 725 pre-applied thereon and covered by a removable cover sheet as described above. Alternatively, the adhesive layer 725 can be applied to the lip 758 and/or frame 44 as part of the procedure to install the shaping member 712 on the window structure. Once the shaping member 712 has been properly secured over the glass pane 40, the cavity 718 created by the shaping member 712 and the window structure is filled with the fluidic compressible material to form the layer of solidified compressible material 720, thereby forming compressible structure 716. It should be appreciated that the lip 758 does not have to be attached to the frame 44 but, rather, can be attached to the glass pane 40 or to a release film previously applied to the glass pane.

Figure 13:
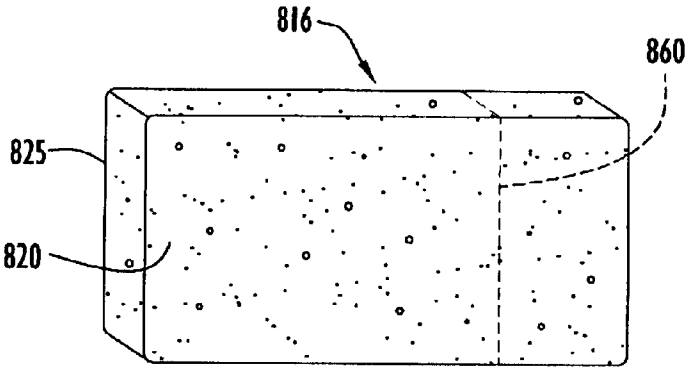
FIG. 13 is a front perspective view of still another modified compressible structure.

An alternative compressible structure 816 is illustrated in FIG. 13 and is a pre-formed, pre-fabricated foam panel providing a layer of solidified compressible material 820, the back surface of which can be provided with an adhesive layer 825 by which the foam panel can be secured to a window structure to protect one or more glass panes thereof from damage. As shown by a dotted line 860, the pre-shaped panel 816 can be cut to fit various shapes and sizes of windows.

Figure 14:
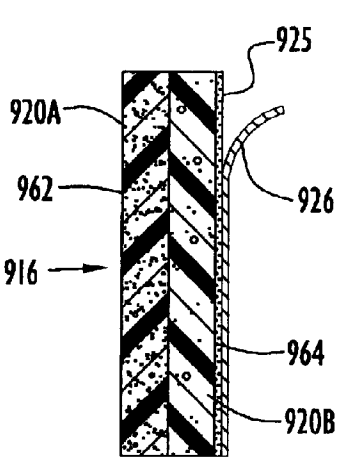
FIG. 14 is a side sectional view of an additional modified compressible structure.

FIG. 14 illustrates an additional alternative compressible structure 916, which is similar to compressible structure 816 except that the layer of solidified compressible material defining the foam panel comprises a plurality of layers of solidified compressible materials of different densities. Compressible structure 916 includes an outer or first layer 962 of a first solidified compressible material 920A and an inner or second layer 964 of a second solidified compressible material 920B, the outer and inner layers being laminated or bonded together. The first solidified compressible material 920A is preferably a closed cell foam material of relatively greater density, fewer open pores and, therefore, relatively greater rigidity. The second solidified compressible material 920B is an open or closed cell foam material with a greater number of open pores and, therefore, less rigidity. The layers 962 and 964 can be laminated or bonded together in various ways. The layer 964 carries an adhesive layer 925 covered by a releaseable cover sheet 926. The more rigid foam layer 962 faces the storm and is exposed to the greatest impact from flying debris and wind. The less rigid foam layer 964 is disposed between the layer 962 of greater rigidity and the glass pane and provides a cushioning effect between the more rigid layer and the glass pane.

Figure 15:
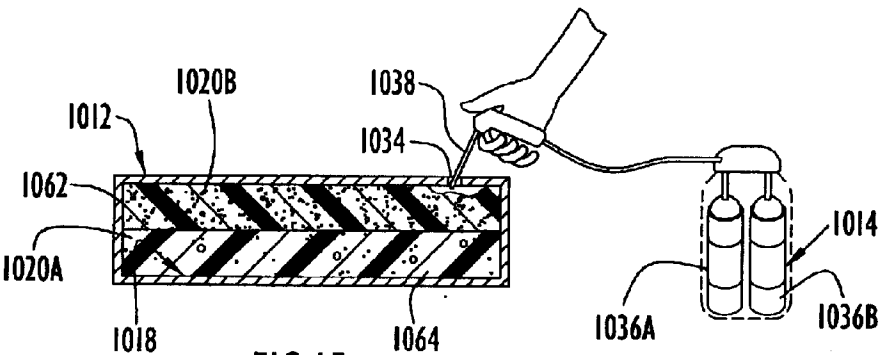
FIG. 15 is a side sectional view illustrating formation of a further modified compressible structure.

FIG. 15 is illustrative of a procedure for filling a shaping member 1012 with first and second fluidic compressible materials to obtain first and second layers of first and second solidified compressible materials of different densities, respectively. FIG. 15 illustrates shaping member 1012, which is similar to shaping member 12, placed in a horizontal position wherein the shaping member will typically be supported on a table, the ground or other support surface. A supply system 1014 is used to deliver a first fluidic compressible material from a tank 1036A to cavity 1018 via a delivery device or nozzle 1038 inserted in port 1034, the first fluidic compressible material forming a first layer 1064 of a first solidified compressible material 1020A of a first density. Once the first fluidic compressible material has been supplied to the cavity in a uniform or substantially uniform layer and has been allowed to set somewhat to form the first layer 1064 of first compressible solidified material 1020A, a second fluidic compressible material is supplied to the cavity from a tank 1036B via the delivery device or nozzle 1038 inserted in port 1034 as shown in FIG. 15. The second fluidic compressible material is applied in a layer over the first compressible material until the cavity is filled and forms a layer 1062 of a second solidified compressible material 1020B greater in density than the first solidified compressible material 1020A. Of course, the first and second fluidic compressible materials can be contained in different supply systems. The delivery device or nozzle 1038 is similar to nozzle 38 except that the delivery device or nozzle 1038 is extendable for delivery of the fluidic compressible materials remote from the tanks 1036A and 1036B.

Figure 16:
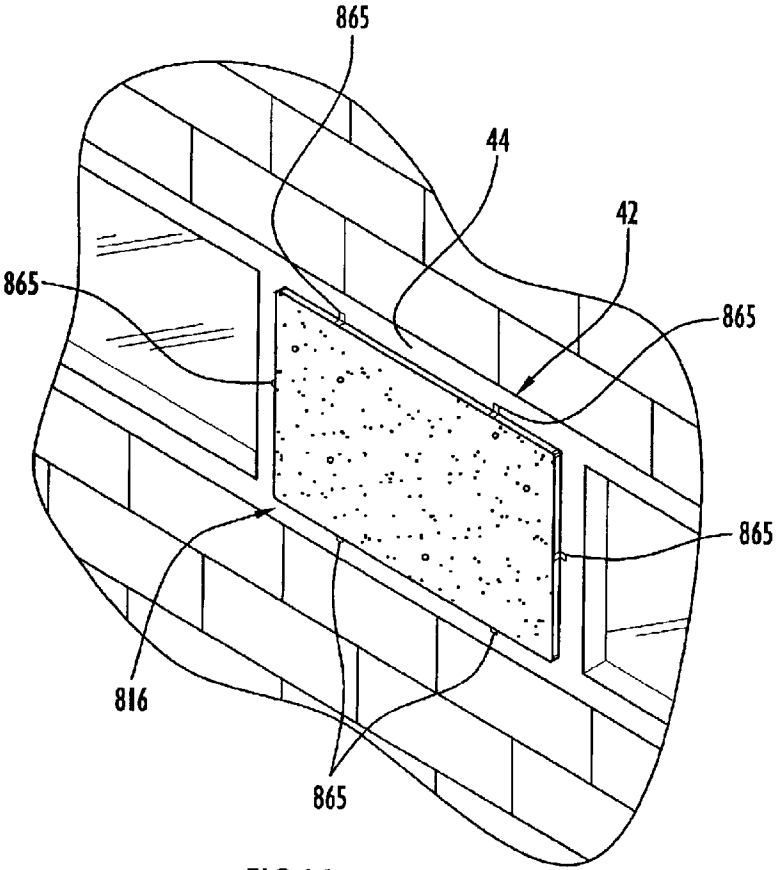
FIG. 16 is a front perspective view of the compressible structure of FIG. 13 positioned over the exterior of a glass pane of a window structure in a building.

FIG. 16 illustrates the compressible structure 816 secured over a glass pane of a window structure 42 to form a protected window structure using a securing element including one or more mechanical securing devices 865 in the form of spring clips inserted or interposed between the perimetrical edges, i.e. the external perimeter, of the compressible structure 816 and frame 44. The securing devices 865 are spring biased to hold the compressible structure 816 in place on window structure 42 and are compressible to allow the compressible structure to be removed from the window structure. The mechanical securing devices may alternatively be designed as non-spring clips.

Figure 17:
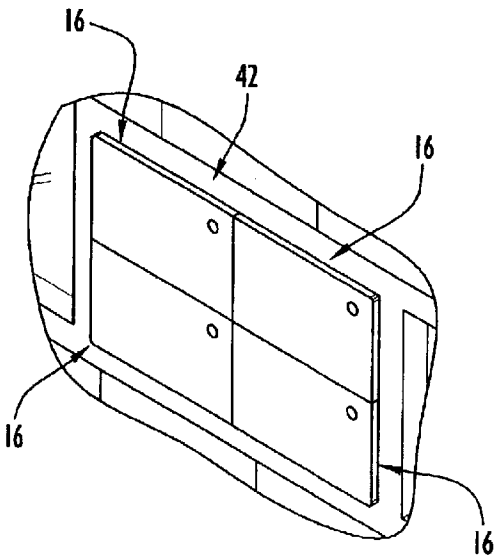
FIG. 17 is a front perspective view illustrating a plurality of compressible structures positioned over the exterior of a glass pane of a window structure in a building.

FIG. 17 illustrates a protected window structure formed by a plurality of compressible structures 16 arranged over a glass pane of window structure 42 so that the entire surface area of the glass pane is covered by the plurality of compressible structures.

Figure 18:
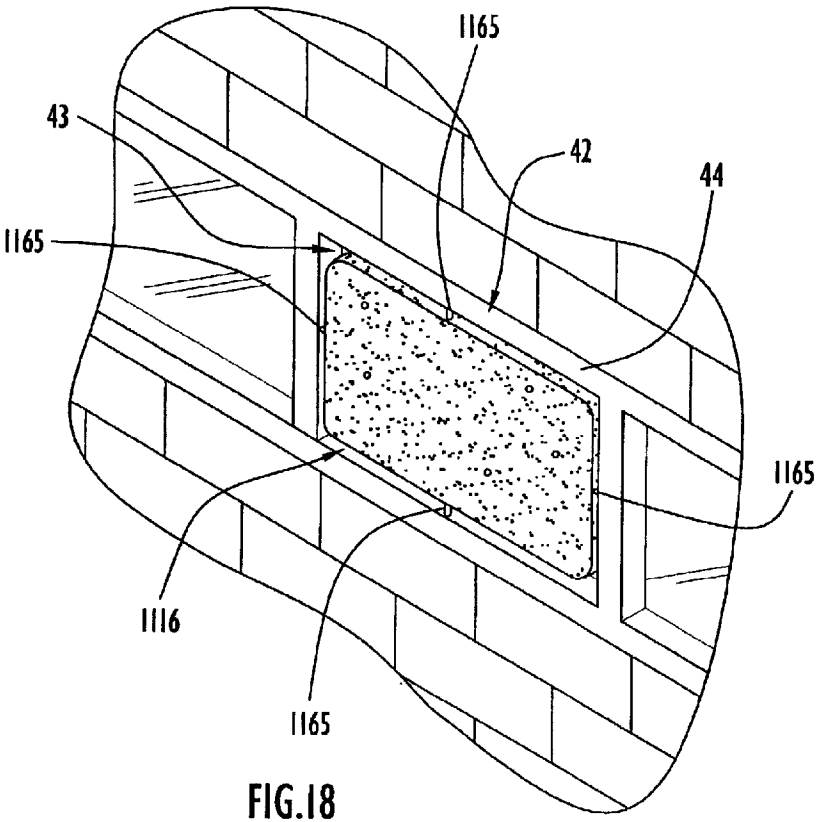
FIG. 18 is a front perspective view of a compressible structure positioned over the exterior of a glass pane of a window structure in a building such as to be centered within a recess of the window structure.

FIG. 18 illustrates a compressible structure 1116 secured over a glass pane of a window structure 42 using a plurality of alternative mechanical securing devices 1165. The compressible structure 1116 is similar to compressible structure 816, but is smaller in peripheral or perimetrical size than the recess 43 of window structure 42. The compressible structure 1116 is centered within recess 43 and is removably held in place over the glass pane by the securing devices 1165. The securing devices 1165 are interposed between frame 44 and the side, top and bottom walls of compressible structure 1116. The securing devices 1165 are extendable and retractable in a longitudinal direction to span the gap between the perimeter of the compressible structure 1116 and the frame 44 and tightly hold the compressible structure in place. The securing devices 1165 are shown without a spring bias but may be designed to incorporate an outward spring bias in the longitudinal direction.

Figure 19:
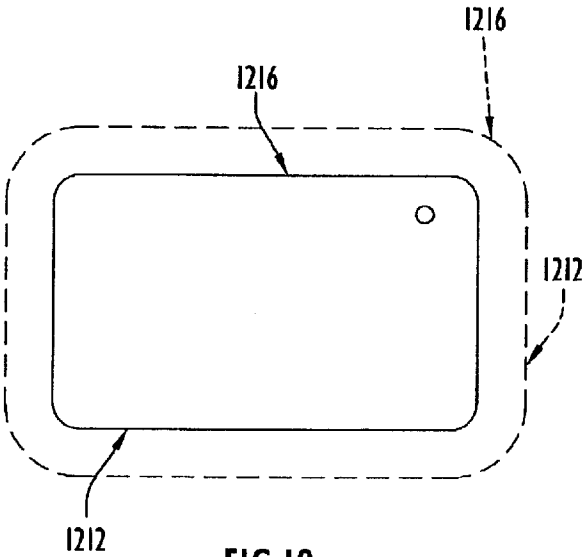
FIG. 19 is a front view showing expansion of a shaping member to different external sizes.

A compressible structure 1216 that is adjustable in external size is illustrated in FIG. 19. The compressible structure 1216 is similar to compressible structure 16 and is made of flexible material or of elastic or stretchable material such that the external size of the shaping member 1212 can be adjusted or controlled by controlling the amount of fluidic compressible material supplied to the shaping member 1212. FIG. 19 illustrates the shaping member 1212 and, therefore, compressible structure 1216 obtained therewith, having a first external size when filled with a quantity of compressible material and illustrates the shaping member 1212 and, therefore, the compressible structure 1216, having a second external size, greater than the first external size, when filled with a greater quantity of the compressible material. Where the shaping member is made of a flexible but inelastic material, any excess material not filled with compressible material can be folded over the layer of solidified compressible material.

Figure 20:
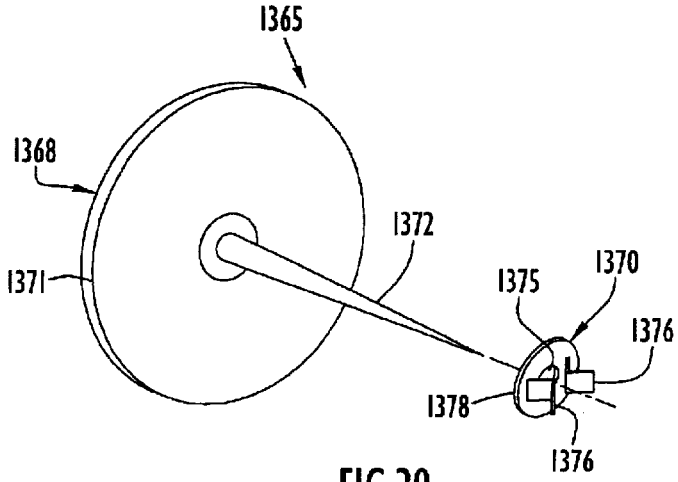
FIG. 20 is an exploded perspective view of a securing device for the compressible structures according to the present invention.
Figure 22:
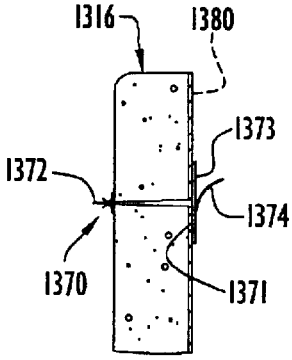
FIG. 22 is a broken side view showing the pin releasably engaged with a clip of the securing device to removably attach the securing device to the compressible structures and illustrating removal of a backing sheet of the securing device to expose an adhesive.

FIG. 20 illustrates an alternative securing device 1365, one or more of which can be used as a securing element for the compressible structures of the present invention. Securing device 1365 includes an attachment member 1368 for attachment to a compressible structure and a clip 1370 for retaining the attachment member on the compressible structure. The attachment member 1368 includes a planar base 1371 and an elongate pin 1372 extending perpendicularly from the forward face of base 1371. As shown in FIG. 22, a rearward face of base 1371 carries a layer of pressure sensitive adhesive 1373 optionally covered by a removable backing sheet or liner 1374. The base 1371 is preferably of minimal thickness to lay flat against the compressible structure and is shown as being circular in external configuration, but can be of any desired external shape. Pin 1372 has a length greater than the thickness of the compressible structure with which the securing device 1365 is to be used so that a forward end of pin 1372 protrudes from the compressible structure when the attachment member 1368 is attached thereto as explained further below. Preferably, the forward end of pin 1372 tapers to a point to facilitate penetration of the compressible structure by the attachment member. The base and pin can be made of the same material or different materials, which may include metal, wood, polymer and fiber. Clip 1370 can be designed in various ways to retain the attachment member on the compressible structure and is shown as having an opening 1375 for slidably receiving the forward end of pin 1372 therethrough and retaining members or legs 1376 disposed around opening 1375 for releasably, lockingly engaging the forward end of pin 1372 passing through opening 1375. The legs 1376 may be bent or angled and/or may be biased inwardly toward the center of opening 1375 to apply a locking force on pin 1372. In the case of clip 1370, the locking force is applied by the bent or angled portions of legs 1376. The ends of legs 1376 may be manually squeezed or compressed to release the bent or angled portions from locking engagement with the pin 1372, allowing the clip 1370 to be moved longitudinally along the pin 1372 and, when the legs are released, the legs lockingly engage the pin and prevent longitudinal movement of the clip relative thereto.

Figure 21:
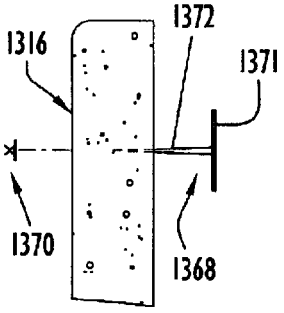
FIG. 21 is a broken side view illustrating insertion of a pin of the securing device through a compressible structure.
Figure 23:
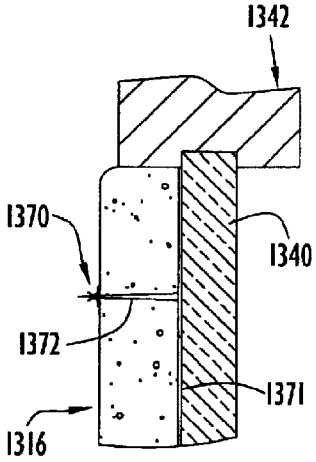
FIG. 23 is a broken side view, partly in section, illustrating the compressible structure releasably adhered to the exterior of a glass pane of a window structure via the adhesive of the securing device.

FIGS. 21–23 illustrate use of securing device 1365 to secure a compressible structure over a glass pane of a window structure. FIG. 21 illustrates the clip 1370 removed from pin 1372 and shows the pin 1372 being inserted through a compressible structure 1316. Compressible structure 1316 is similar to compressible structure 816 and is a pre-formed, pre-fabricated foam panel. However, it should be appreciated that the securing device 1365 can be used with the other compressible structures described herein. The pin 1372 is inserted, forward end first, through the back surface of the compressible structure and is advanced through the compressible structure in a perpendicular direction, with the pointed end of pin 1372 facilitating penetration of the compressible structure by the pin. Once the base 1371 is in abutment with the back surface of the compressible structure 1316 and the forward end of pin 1372 protrudes from the forward surface of the compressible structure, the clip 1370 is assembled to the attachment member 1368. The clip 1370 is placed over the forward end of pin 1372 so that the forward end passes through the opening 1376. The clip 1370 is moved longitudinally along the pin 1372 in the direction of the compressible structure and, if necessary, the legs 1376 may be squeezed or compressed toward one another to facilitate longitudinal movement of the clip along the pin. Once the clip 1370 abuts the forward surface of compressible structure 1316, the legs 1376 are released, and the bent or angled portions will lockingly engage the forward end of pin 1372. The clip 1370 will then be in a locked position on pin 1372 such that the compressible structure 1316 is held between base 1371 and clip 1370. As shown in FIG. 20, the clip 1370 may be provided with a planar flange 1378 for abutting the forward surface of compressible structure 1316 so that the compressible structure is held between the planar flange 1378 and the planar base 1371 as shown in FIG. 22. Once a desired number of securing devices 1365 has been assembled to the compressible structure, the compressible structure is ready to be secured over the glass pane of the window structure. To secure the compressible structure 1316 over the glass pane of a window structure using the securing device 1365, the backing sheet 1374 is removed or peeled away from base 1371 to expose the layer of adhesive 1373 as shown in FIG. 22. Optionally, the back surface of the compressible structure can be coated with an adhesive as shown by adhesive coating 1380 in FIG. 22. The adhesive coating 1380 is preferably a pressure sensitive adhesive weaker than the pressure sensitive adhesive 1373 and serves to bond the compressible structure to the glass pane for additional securing power and also creates a damping effect. Once the adhesive 1373 is exposed by removing backing sheet 1374, the compressible structure 1316 is placed against the glass pane 1340 of window structure 1342. FIG. 23 shows the compressible structure 1316 positioned over the exterior of glass pane 1340 and being secured thereto via the adhesive of base 1371 with the optional adhesive coating 1380 providing additional holding force.

To remove the compressible structure 1316 after a storm has passed, the clip 1370 is withdrawn from pin 1372. Withdrawal of the clip 1370 from the pin 1372 may be accomplished by squeezing the legs 1376 and sliding the clip along the pin in a direction away from the compressible structure 1316 until the pin is removed from the opening 1375. The compressible structure 1316 may then be grasped and moved or pulled away from the glass pane 1340 in a direction perpendicular thereto so that the compressible structure is also removed entirely from the pin 1372. The attachment member 1368 can now be removed from the glass pane by pulling an edge of base 1371 to release adhesive 1373 from its bond with the glass pane. Removal of base 1371 may be facilitated by using a razor blade or a solvent, if needed. Upon removal of the compressible structure 1316 from the attachment member 1368, the compressible structure can be stored for reuse. The securing device 1365 will typically be disposed of, and one or more new securing devices may be used in the future to secure the compressible structure 1316 to the glass pane of a window structure.

Figure 24:
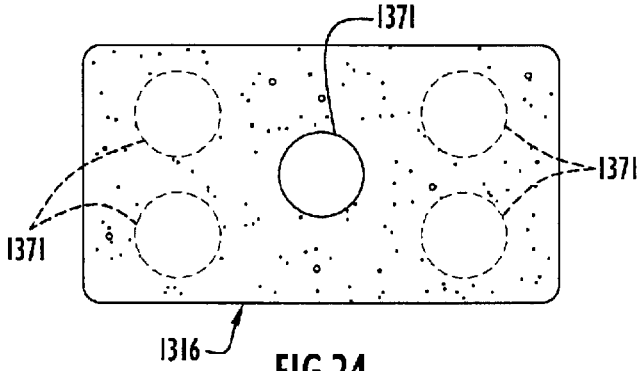
FIG. 24 is a back view of the compressible structure with the securing device releasably attached thereto.

Depending on the external size of the compressible structure, one or more securing devices 1365 may be used to secure the compressible structure to the glass pane. The number of securing devices 1365 needed may also depend on the size of the securing devices. For instance, the base 1371 may be provided in various external sizes, for example, ranging from one inch to twelve inches in diameter. FIG. 24 shows the back surface of compressible structure 1316 with the base 1371 of the attachment member 1368 for the securing device being disposed at a central location on the compressible structure. As shown by bases 1371 in dotted lines, additional securing devices can be assembled to the compressible structure 1316 at other desired locations.

Various adhesives can be used in the present invention, examples of which include polyurethane, cyanoacrylate, acrylate, epoxy, silicone, films, polyesters, rubber, hot melt polyolefins, polyamide, block copolymers, polyvinyl acetate, and vinyl acetate ethylene. Various release agents may be used to facilitate removal of the compressible structures from the window structures, and examples of such release agents include petroleum based substances, alcohols, aliphatic hydrocarbons, aromatic hydrocarbons, halogenated solvents, glycol ethers, methyl ethyl ketone, xylene, d-limonene, phthalate and benzoates. Examples of catalysts which may be used in the present invention to speed up reaction and/or curing times include amine catalysts, organometallic, bismuth and zinc organics.

Inasmuch as the present invention is subject to various modifications and changes in detail, it should be appreciated that the preferred embodiments described herein should be considered as illustrative only and should not be taken in a limiting sense.

What is claimed is:

1. A window protection system for temporarily protecting a glass pane of a window structure comprising a shaping member for removable securement on the window structure, said shaping member defining a cavity disposed over the glass pane when said shaping member is removably secured on the window structure; and a fluidic polymeric foam material for being introduced in said cavity, said fluidic material being capable of solidifying within said cavity into a body of shock absorbing compressible material providing shock absorbing protection for the glass pane.

2. A protected window structure comprising a window structure including a frame circumscribing an area containing exposed glass having an exterior facing side;

a shaping member removably secured on said window structure and defining a cavity over said exterior facing side of said glass;

a body of solidified compressible material in said cavity of a size to cover said area circumscribed by said frame at least substantially in its entirety to provide protection for said glass, said compressible material being supplied to said cavity in a fluidic form and solidifying in said cavity; and a port in said shaping member communicating with said cavity by which said compressible material is supplied to said cavity in said fluidic form.

3. A protected window structure as recited in claim 2 wherein said compressible material is a polymeric foam.

4. A window protection system as recited in claim 1 and further including a securing element for removably securing said shaping member on the window structure.

5. A window protection system as recited in claim 4 wherein said securing element includes a releasable adhesive carried by said shaping member.

6. A window protection system as recited in claim 4 wherein said shaping member has an external perimeter and said securing element includes one or more securing devices for being interposed between said perimeter and the window structure.

7. A compressible structure for temporarily protecting a glass pane of a window structure comprising a shaping member for removable securement on the window structure, said shaping member defining a cavity disposed over the glass pane when said shaping member is removably secured on the window structure;

a layer of solidified compressible material in said cavity, said shaping member and said solidified compressible material forming a compressible structure providing protection for the glass pane; and a securing element for removably securing said compressible structure on the window structure, said securing element including one or more securing devices each including an attachment member and a clip, said attachment member having a planar base for being releasably, adhesively secured to the window structure and a pin extending perpendicularly from said base for penetrating said compressible structure so that a forward end of said pin protrudes from said compressible structure, said clip including an opening for receiving said forward end therethrough in releasable locking engagement to retain said compressible structure between said clip and said base.

8. A protected window structure as recited in claim 3 wherein said shaping member includes a front wall, a back wall disposed adjacent to the glass and one or more side walls connecting said front and back walls, said cavity being defined between said front and back walls.

9. A compressible structure for temporarily protecting a glass pane of a window structure comprising a shaping member for removable securement on the window structure, said shaping member defining a cavity disposed over the glass pane when said shaping member is removably secured on the window structure, said shaping member including a front wall, a back wall for being disposed adjacent the glass pane and one or more side walls connecting said front and back walls, said cavity being defined between said front and back walls, said back wall being made of a sponge material;

a layer of solidified compressible material in said cavity providing protection for the glass pane, said compressible material being a polymeric foam; and a port in said shaping member communicating with said cavity by which said compressible material is supplied to said cavity in fluidic form for solidification within said cavity.

10. A compressible structure for temporarily protecting a glass pane of a window structure comprising a shaping member for removable securement on the window structure, said shaping member defining a cavity disposed over the glass pane when said shaping member is removably secured on the window structure, said shaping member including a front wall, a back wall for being disposed adjacent the glass pane and one or more side walls connecting said front and back walls, said cavity being defined between said front and back walls, said back wall including spaced layers and a cushioning structure between said layers;

a layer of solidified compressible material in said cavity providing protection for the glass pane, said compressible material being a polymeric foam; and a port in said shaping member communicating with said cavity by which said compressible material is supplied to said cavity in fluidic form for solidification within said cavity.

11. A compressible structure as recited in claim 10 wherein said cushioning structure includes a plurality of air cells.

12. A compressible structure as recited in claim 10 wherein said cushioning structure includes a plurality of polymeric particles.

13. A compressible structure for temporarily protecting a glass pane of a window structure comprising a shaping member for removable securement on the window structure, said shaping member defining a cavity disposed over the glass pane when said shaping member is removably secured on the window structure, said shaping member including a front wall, a back wall for being disposed adjacent the glass pane and one or more side walls connecting said front and back walls, said cavity being defined between said front and back walls;

a cushioning element carried by said back wall;

a layer of solidified compressible material in said cavity providing protection for the glass pane, said compressible material being a polymeric foam; and a port in said shaping member communicating with said cavity by which said compressible material is supplied to said cavity in fluidic form for solidification within said cavity.

14. A compressible structure for temporarily protecting a glass pane of a window structure comprising a shaping member for removable securement on the window structure, said shaping member defining a cavity disposed over the glass pane when said shaping member is removably secured on the window structure, said shaping member including a front wall, a back wall for being disposed adjacent the glass pane and one or more side walls connecting said front and back walls, said cavity being defined between said front and back walls;

a layer of solidified compressible material in said cavity providing protection for the glass pane, said compressible material being a polymeric foam and being a releasably adherable material supplied to said cavity in fluidic form and thereafter solidifying;

a port in said shaping member communicating with said cavity by which said compressible material is supplied to said cavity in fluidic form for solidification within said cavity; and an opening in said shaping member by which said compressible material in fluidic form contacts the window structure to releasably adhere said shaping member to the window structure when said compressible material solidifies.

15. A compressible structure for temporarily protecting a glass pane of a window structure comprising a shaping member for removable securement on the window structure, said shaping member defining a cavity disposed over the glass pane when said shaping member is removably secured on the window structure, said shaping member including a front wall, a back wall for being disposed adjacent the glass pane and one or more side walls connecting said front and back walls, said cavity being defined between said front and back walls, said front wall being made of a high strength, impact resistant material;

a layer of solidified compressible material in said cavity providing protection for the glass pane, said compressible material being a polymeric foam; and a port in said shaping member communicating with said cavity by which said compressible material is supplied to said cavity in fluidic form for solidification within said cavity.

16. A protected window structure comprising a window structure having a glass pane mounted in a frame;

a shaping member removably secured on said window structure and defining a cavity over said glass pane, said shaping member including a front wall and one or more side walls extending rearwardly from said front wall to contact said window structure, said front wall being spaced from said glass pane by said one or more side walls, said cavity being defined between said front wall and said glass pane;

a layer of solidified compressible material in said cavity providing protection for said glass pane, said compressible material being a polymeric foam; and a port in said shaping member communicating with said cavity by which said compressible material is supplied to said cavity in fluidic form for solidification within said cavity.

17. A compressible structure for temporarily protecting a glass pane of a window structure comprising a shaping member for removable securement on the window structure, said shaping member defining a cavity disposed over the glass pane when said shaping member is removably secured on the window structure; and a layer of solidified compressible material in said cavity providing protection for the glass pane, said layer of solidified compressible material including a first layer of a first solidified compressible material and a second layer of a second solidified compressible material disposed over said first layer, said first and second solidified compressible materials being of different densities.

18. A compressible structure as recited in claim 17 wherein said first solidified compressible material is of greater density than said second solidified compressible material.

19. A compressible structure as recited in claim 18 wherein said second layer of said second solidified compressible material is disposed between the glass pane and said first layer of said first solidified compressible material.

20. A protected window structure as recited in claim 2 wherein said body of solidified compressible material has a thickness in the range of 0.5 inch to 12.0 inches.

21. A protected window structure as recited in claim 20 wherein said body of solidified compressible material has a thickness in the range of 1.0 inch to 4.0 inches.

22. A window protection system as recited in claim 1 wherein said shaping member is adjustable in external size in response to a variation in the amount of said fluidic material introduced in said cavity.

23. A window protection system as recited in claim 1 and further comprising a port in said shaping member establishing communication with said cavity from externally of said shaping member and a delivery device for supplying said fluidic material through said port and into said cavity.

24. A protected window structure as recited in claim 2 and further including a securing element for removably securing said shaping member on said window structure.

25. A protected window structure as recited in claim 24 wherein said securing element includes an adhesive.

26. A protected window structure as recited in claim 24 wherein said securing element includes one or more mechanical securing devices.

27. A window protection system for temporarily protecting a glass pane of a window structure comprising a shaping member for removable securement on a window structure, said shaping member defining a cavity disposed over the glass pane when said shaping member is removably secured on the wiiindo;

a port in said shaping member establishing communication with said cavity from externally of said shaping member; and a supply system including a quantity of compressible material in fluid form and a delivery device for supplying said compressible material in fluid form through said port and into said cavity, said compressible material in fluid form solidifying within said cavity to form a layer of solidified compressible material thereby forming a compressible structure, defined by said shaping member and said layer of solidified compressible material, over the glass pane to provide protection thereto, said quantity of compressible material in fluid form including a quantity of a first compressible material in fluid form for forming a first layer of a first solidified compressible material having a first density and a quantity of a second compressible material in fluid form for forming a second layer of a second compressible material having a second density greater than said first density.

28. A temporarily protected window structure comprising a window structure having a glass pane mounted in a frame; and a compressible structure removably secured on said window structure and including a panel of solidified compressible foam material disposed over the exterior of said glass pane with said panel having a thickness extending perpendicular to said glass pane, said thickness being compressible and said compressible material having a compression strength in the range of 15 to 40 psi to protect said glass pane from damage due to storms.

29. A protected window structure as recited in claim 28 and further including a securing element removably securing said compressible structure on said window structure.

30. A protected window structure as recited in claim 29 wherein said securing element includes an adhesive.

31. A protected window structure as recited in claim 29 wherein said securing element includes one or more mechanical securing devices.

32. A protected window structure as recited in claim 31 wherein said compressible structure has an external perimeter and said one or more securing devices are interposed between said perimeter and said window structure.

33. A temporarily protected window structure comprising a window structure having a glass pane mounted in a frame;

a compressible structure removably secured on said window structure and including a panel of solidified compressible foam material disposed over said glass pane to protect said glass pane from damage due to storms; and a securing element removably securing said compressible structure on said window structure, said securing element including one or more mechanical securing devices, said one or more securing devices each including an attachment member and a clip, said attachment member having a planar base releasably, adhesively secured to said window structure and a pin extending perpendicularly from said base for penetrating said compressible structure so that a forward end of said pin protrudes from said compressible structure, said clip including an opening for receiving said forward end therethrough in locking engagement to retain said compressible structure between said clip and said base.

34. A temporarily protected window structure comprising a window structure having a glass pane mounted in a frame;

a compressible structure removably secured on said window structure and including a panel of solidified compressible foam material disposed over said glass pane to protect said glass pane from damage due to storms, said panel of solidified compressible material including a first layer of a first solidified compressible material having a first density and a second layer of a second solidified compressible material disposed over said first layer and having a second density greater than said first density; and a securing element removably securing said compressible structure on said window structure.

35. A protected window structure as recited in claim 34 wherein said first layer is disposed between said second layer and said glass pane.

36. A method of temporarily protecting a glass pane of a window structure in a building from storm damage, comprising the steps of before a storm arrives, releasably securing a pre-formed panel of solidified compressible foam material over the exterior of the glass pane with the thickness of the panel perpendicular to the glass pane;

leaving the panel in place during the storm;

compressing the thickness of the panel in response to objects forcefully striking the panel during the storm to protect the glass pane from damage; and after the storm has passed, removing the panel from the glass pane.

37. A method of temporarily protecting a glass pane as recited in claim 36 wherein said step of releasably securing includes adhesively securing the panel to the glass pane.

38. A method of temporarily protecting a glass pane as recited in claim 36 wherein said step of releasably securing includes positioning one or more securing devices between the window structure and an external perimeter of the panel.

39. A method of temporarily protecting a glass pane of a window structure in a building from storm damage, comprising the steps of before a storm arrives, releasably securing a pre-formed panel of solidified compressible material over the glass pane, said step of releasably securing including the steps of inserting a pin of an attachment member through the panel so that a base of the attachment member abuts a back surface of the panel and a forward end of the pin protrudes from a forward surface of the panel, positioning a clip on the forward end of the pin to releasably, lockingly retain the panel between the clip and the base, and releasably attaching the base to the window structure;

leaving the panel in place during the storm to protect the glass pane from damage; and after the storm has passed, removing the panel from the glass pane.

40. A method of temporarily protecting a glass pane as recited in claim 39 wherein said step of releasably attaching includes releasably attaching the base to the window structure adhesively.

41. The method of temporarily protecting a glass pane as recited in claim 36 and further including, subsequent to said step of removing, the step of storing the panel for reuse.

42. A method of temporarily protecting a glass pane of a window structure in a building from storm damage, comprising the steps of before a storm arrives, removably securing a shaping member on the window structure so that a cavity defined by the shaping member is disposed over at least a portion of the glass pane;

supplying a fluidic compressible material to the cavity;

allowing the fluidic compressible material to cure and form a layer of solidified compressible material thereby forming a compressible structure over at least a portion of the glass pane;

leaving the compressible structure in place during the storm to protect the window structure from damage; and after the storm has passed, removing the compressible structure from the window structure.

43. A window protection system as recited in claim 1 wherein said fluidic material is capable of solidifying into a body of compressible material including cells in the size range of 0.005 mm to 5.0 mm.

44. A protected window structure as recited in claim 2 wherein said exposed glass includes one or more glass panes.

45. A protected window structure as recited in claim 2 wherein said body of solidified compressible material covers the entirety of said area circumscribed by said frame.

* * * * *